US007453401B2

(12) United States Patent
Jow

(10) Patent No.: US 7,453,401 B2
(45) Date of Patent: Nov. 18, 2008

(54) VERTICAL COMPLEMENTARY FRACTAL ANTENNA

(75) Inventor: Uei-Ming Jow, Hsinchu (TW)

(73) Assignee: Industrial Technology Rersearch Institute, Hsinchu (TW)

( * ) Notice: Subject to any disclaimer, the term of this patent is extended or adjusted under 35 U.S.C. 154(b) by 169 days.

(21) Appl. No.: 11/261,568

(22) Filed: Oct. 31, 2005

(65) Prior Publication Data

US 2006/0267842 A1 Nov. 30, 2006

(30) Foreign Application Priority Data

May 27, 2005 (TW) ..... 94117602 A

(51) Int. Cl.
*H01Q 1/38* (2006.01)

(52) U.S. Cl. ..... 343/700 MS; 343/792.5; 343/846

(58) Field of Classification Search ..... 343/700 MS, 343/702, 792.5, 846, 895
See application file for complete search history.

(56) References Cited

U.S. PATENT DOCUMENTS 6,127,977 A 10/2000 Cohen
6,140,975 A * 10/2000 Cohen ..... 343/846
6,476,766 B1 11/2002 Cohen
6,642,898 B2 11/2003 Eason
7,019,695 B2 * 3/2006 Cohen ..... 343/700 MS

OTHER PUBLICATIONS

Ban-Leong Ooi, et al., "A Modified Contour Integral Analysis for Sierpinski Fractal Carpet Antennas With and Without Electromagnetic Band Gap Ground Plane." IEEE Transactions on Antennas and Propagation, vol. 52, No. 5, May 2004.

* cited by examiner

*Primary Examiner*—Tho G Phan
(74) *Attorney, Agent, or Firm*—Harness, Dickey & Pierce P.L.C.

(57) ABSTRACT

A vertical complementary fractal antenna is provided, which includes a first fractal structure and a second fractal structure. The first fractal structure is defined as a superposition over at least one iteration of a motif, while the second fractal structure has a pattern complementary to that of the first fractal structure. Thus, the antenna may effectively increase bandwidth.

25 Claims, 7 Drawing Sheets

VERTICAL COMPLEMENTARY FRACTAL ANTENNA

This application claims the benefit of Taiwan Patent Application No. 94117602, filed on May 27, 2005, which is hereby incorporated by reference for all purposes as if fully set forth herein.

BACKGROUND OF THE INVENTION

1. Field of Invention

The invention relates to an antenna, and more specifically to an antenna with a vertical complementary fractal structure.

2. Related Art

With the rapid development of wireless communication and semiconductor technology, wireless communication has become an indispensable part of life. A wireless communication system is comprised of a transmitter/receiver and antennas, wherein the antennas are used to convert electrical energy into electromagnetic energy or vice versa. This is one of most important components in communication systems. Given the demand for the miniaturization and multi-band capability of electronic devices, the current trend of antenna design is towards miniaturization, structural simplification, and multi-band or wide-band capability.

Many existing studies have focused on microstrip antennas and array antennas. In general, microstrip antennas have the advantages of being easy to produce, small in size, light weight, and low profile. However, they also have the problems of low radiation efficiency and narrow band.

Another type of antenna under development is the fractal antenna. By drawing upon electromagnetic theory, the concept of the fractal structure has been successfully applied to issues related to electromagnetic radiation, transmission, and scattering field. Because of their characteristic of self-similarity, fractal antennas are characterized by unlimited bandwidth. Thus the development of fractal antennas has received increasing attention.

At present, there are two kinds of applications of the fractal structure: one is to directly use existing fractals and the other is to develop new fractal structures based on the characteristic of self-similarity of fractals. By incorporating the array fractal antennas to microstrip antennas, the problems of microstrip antennas may be overcome with the multi-band capability and high gain of fractal antennas.

The relevant prior art discloses a fractal antenna, and the main idea of the fractal antenna is to change the shapes of the holes of the ground connection plane to control the radiation efficiency. See, for example, Ban-Leong Ooi, "A Modified Contour Integral Analysis for Sierpinski Fractal Carpet Antennas With and Without Electromagnetic Band Gap Ground Plane", IEEE TRANSACTIONS ON ANTENNAS AND PROPAGATION, VOL. 52, NO. 5, MAY 2004.

U.S. Pat. No. 6,127,977 discloses a fractal antenna using a two-layer fractal structure to increase bandwidth and radiation efficiency. U.S. Pat. No. 6,642,898 discloses a fractal cross slot antenna using cross slots with a linear fractal structure instead of conventional non-fractal cross slots. The type of fractal antenna disclosed in U.S. Pat. No. 6,476,766 achieves its compact design by staggering the slot structures at the upper level and lower level.

Reducing the size of antennas has always been an important objective of the field. In general, antennas without consideration of the ground connection plane design are of a larger size. Antennas with a ground connection design are of a smaller size; however, they occupy a large area of ground and space. Because fractal antennas are a type of newlydeveloped antenna that have attracted a great deal of attention, it is often thought that certain characteristics of fractal antennas are helpful to reduce the size, increase the bandwidth, and to improve the radiation field of the antennas. However, in practical use, in order to achieve higher radiation efficiency, fractal antennas usually do not adopt a ground connection plane. The prior art does not disclose any fractal antennas having a ground connection design.

SUMMARY OF THE INVENTION

The invention provides a vertical complementary fractal antenna to solve the problems described above.

An exemplary embodiment of the invention provides a vertical complementary fractal antenna having a first fractal structure, wherein the first fractal structure is defined as a superposition over N iterations of a fundamental motif, with $N \geqq 1$, and a ground layer made of a conductive material having a second fractal structure corresponding to the first fractal structure.

According to another exemplary embodiment of the invention, in order to decrease the size of the antenna and also incorporate a ground connection plane in its design, an antenna with a vertical complementary fractal structure is provided. Previously, since antennas were simple in structure, the ground radiation of antennas with a vertical complementary fractal structure was limited. Microstrip antennas with a vertical complementary fractal structure as disclosed in the invention have a fractal structure at the upper level and a ground connection plane having a complementary fractal structure at the lower level, which not only increases ground radiation, but also reduces the overall size of the antennas and improves the isolation of the radiation from the circuit connected to the antennas.

Further scope of applicability of the invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The above and other objects, features and other advantages of the invention will be more clearly understood from the following detailed description when taken in conjunction with the accompanying drawings, in which.

DETAILED DESCRIPTION OF THE INVENTION

Figure 1:
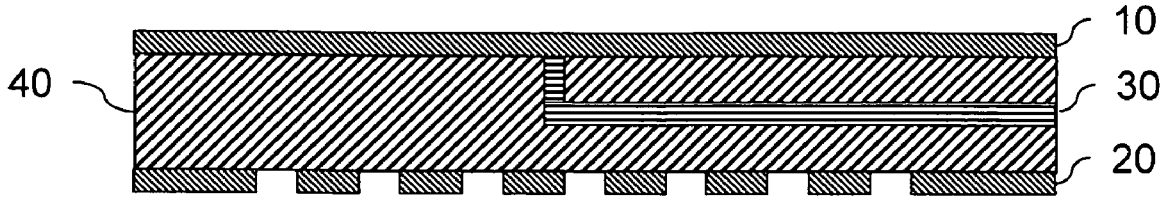
FIG. 1 depicts a vertical complementary fractal antenna according to an exemplary embodiment of the invention.

Reference will now be made in greater detail to a preferred embodiment of the invention, an example of which is illustrated in the accompanying drawings. Wherever possible, the same reference numerals are used throughout the drawings and the description to refer to the same or like parts. Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Referring to FIG. 1, a vertical complementary fractal antenna according to an exemplary embodiment of the invention includes a signal layer 10 and a ground layer 20. The signal layer 10 is connected to a signal source through a wire. Between the signal layer 10 and the ground layer 20 there is a medium, which is an insulating substrate 40, according to an exemplary embodiment of the invention. The signal layer 10 is formed on one surface of the insulating substrate and the ground layer 20 is formed on the other surface of the insulating substrate. In another exemplary embodiment of the invention, the medium could be air.

Figure 2:
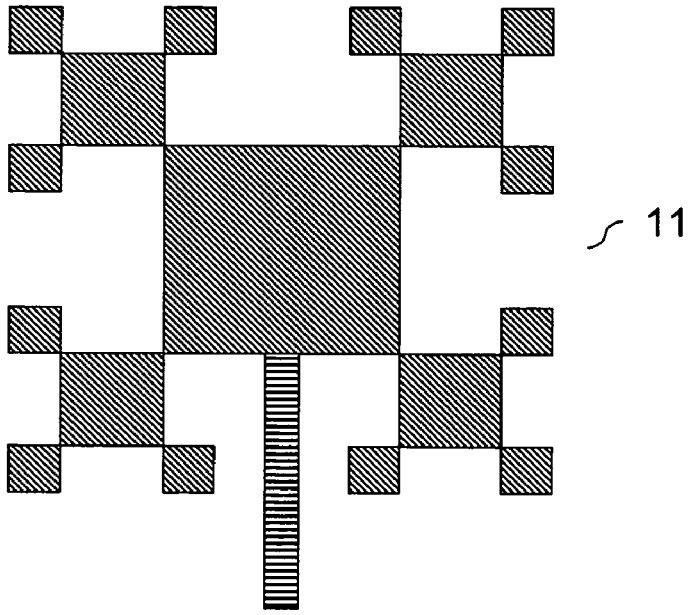
FIG. 2 depicts a first fractal structure disclosed in an exemplary embodiment of the invention.

The signal layer 10 made of a conductive material includes a first fractal structure 11, which is defined as a superposition over N iterations of a fundamental motif, with $N \geqq 1$. As shown in FIG. 2, the first fractal structure 11 is formed by etching away the conductive material in areas other than the desired fractal pattern.

Figure 3:
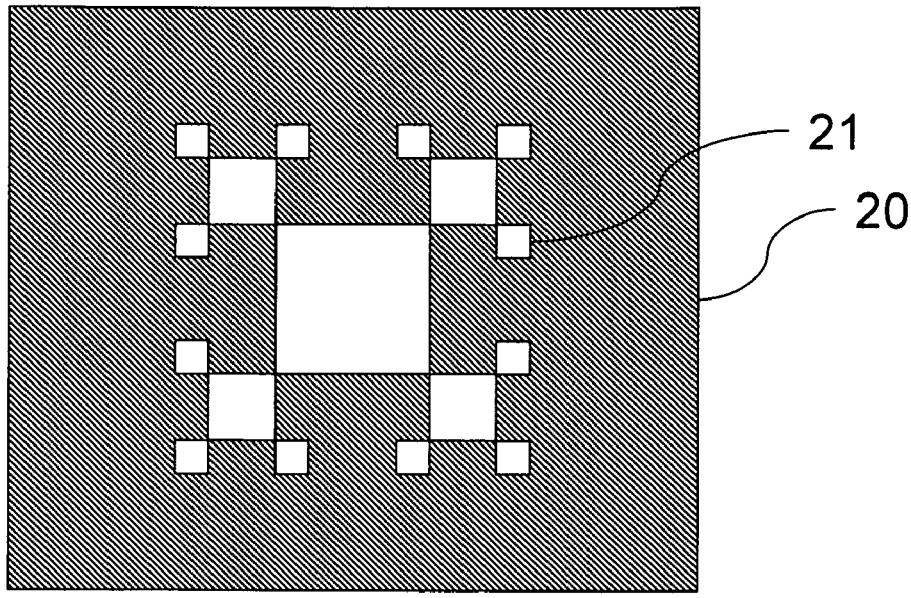
FIG. 3 depicts a second fractal structure disclosed in an exemplary embodiment of the invention.

The ground layer 20 is also made of a conductive material and has a second fractal structure 21 corresponding to the first fractal structure 11. As shown in FIG. 3, the second fractal structure 21 is formed on the ground layer 20 by etching away the part corresponding to the first fractal structure 11. In this exemplary embodiment, the first fractal structure 11 and the second fractal structure 21 are of a similar structure. In another exemplary embodiment, the first fractal structure 11 and the second fractal structure 21 are also of a similar structure, but the cavity area formed through etching on the second fractal structure 21 is larger than that of the first fractal structure 11; i.e., the cavity area of the second fractal structure 21 may be as much as twice that of the first fractal structure 11.

The fractal structure shown in FIGS. 1-3 is for illustration only, and not meant to restrict the fractal structure, the motif, the iteration factor, or the number of iterations. Other commonly-used fractal structures include: (1) Koch , (2) Minkowski, (3) Cantor , (4) torn square , (5) Mandelbrot , (6) Caley tree, (7) monkeys swing , (8) Sierpinski gasket, and (9) Julia, etc.

Figure 4:
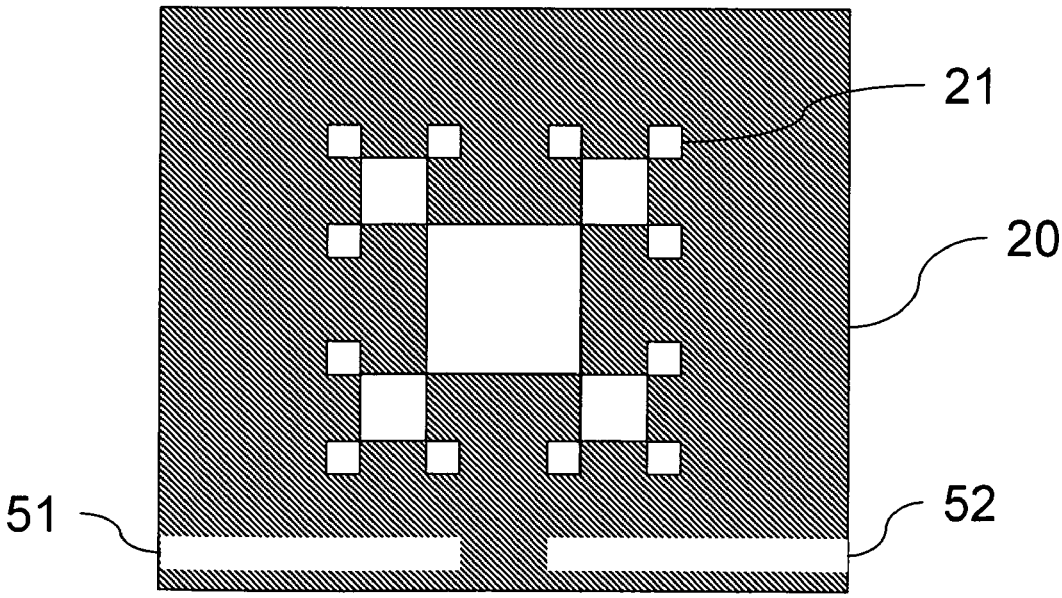
FIG. 4 depicts a vertical complementary fractal antenna according to another exemplary embodiment of the invention.

FIG. 4 shows another exemplary embodiment of the invention. In order to isolate the signal layer or the ground layer from the external circuit, slots 51 and 52 are formed on the antenna to prevent electromagnetic interference (EMI). The slots 51 and 52 are provided between second fractal structure and a signal feeding line, wherein the at least one slot is formed by etching a metal plate on which the second fractal structure is formed. In another embodiment, the slots 51 and 52 are provided between first fractal structure and a signal feeding line, wherein the at least one slot is formed by etching a metal plate on which the first fractal structure is formed. In FIG. 4, the ground layer is used as an example for illustration. However, those slots may also be formed on the signal layer.

Figure 5:
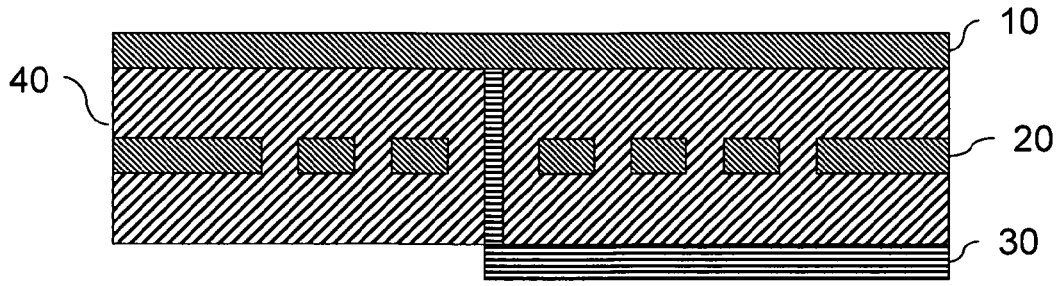
FIG. 5 depicts a vertical complementary fractal antenna according to another exemplary embodiment of the invention.

FIG. 5 provides another exemplary embodiment of the invention, which differs from exemplary embodiment in FIG. 1 in the way the ground layer is set up and the way signals are fed in. In the exemplary embodiment shown in FIG. 5, the ground layer 20 is located within the insulating substrate 40, and the wire 30 is located on the surface of the insulating substrate 40, which is opposite the surface having a signal layer 10.

Figure 6:
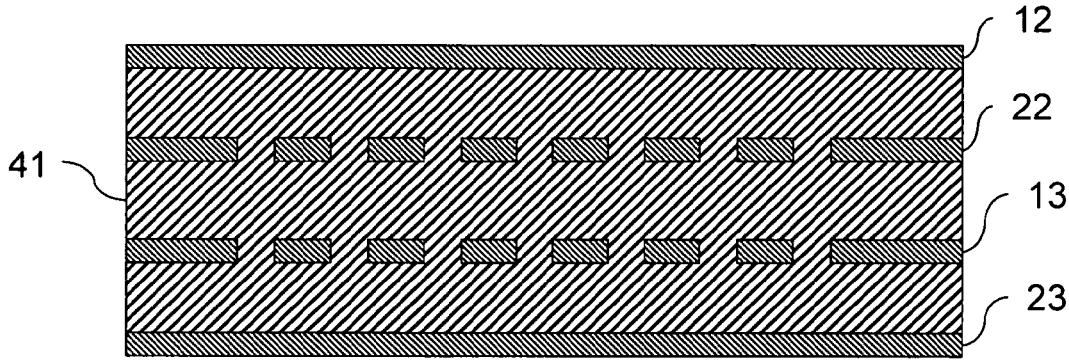
FIG. 6 depicts a vertical complementary fractal antenna according to another exemplary embodiment of the invention.

Referring to FIG. 6, another exemplary embodiment of the invention provides an antenna with an array structure, which may increase the gain of the antenna. As shown in FIG. 6, the ground layer of one set of antenna is positioned adjacent to the ground layer of another set of antenna in such a way that the signal layers 12 and 23 of the two sets of antenna are formed on the two surfaces of the insulating substrate 41, and the ground layers 22 and 13 are formed inside the insulating substrate 41.

Figure 7:
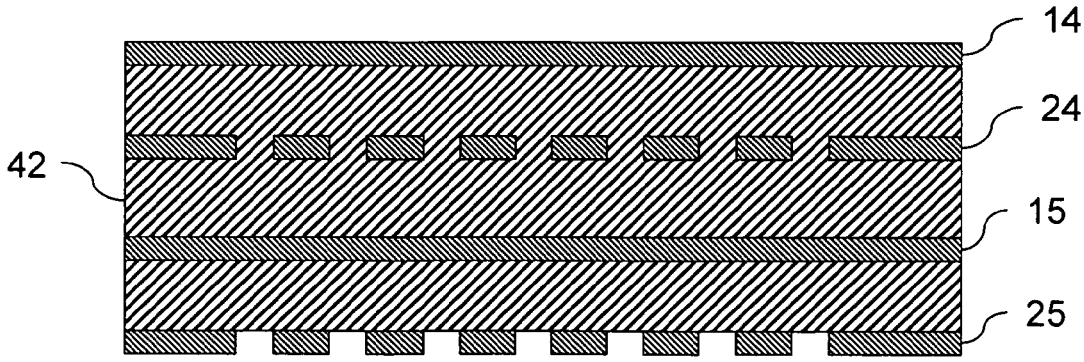
FIG. 7 depicts a vertical complementary fractal antenna according to another exemplary embodiment of the invention.
Figure 8A:
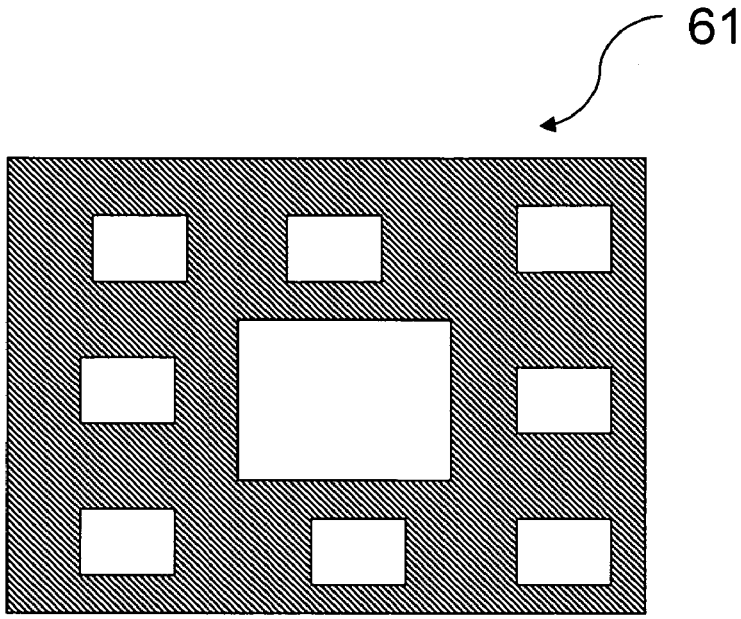
FIG. 8A-8B depicts a vertical complementary fractal antenna according to another exemplary embodiment of the invention.
Figure 8B:
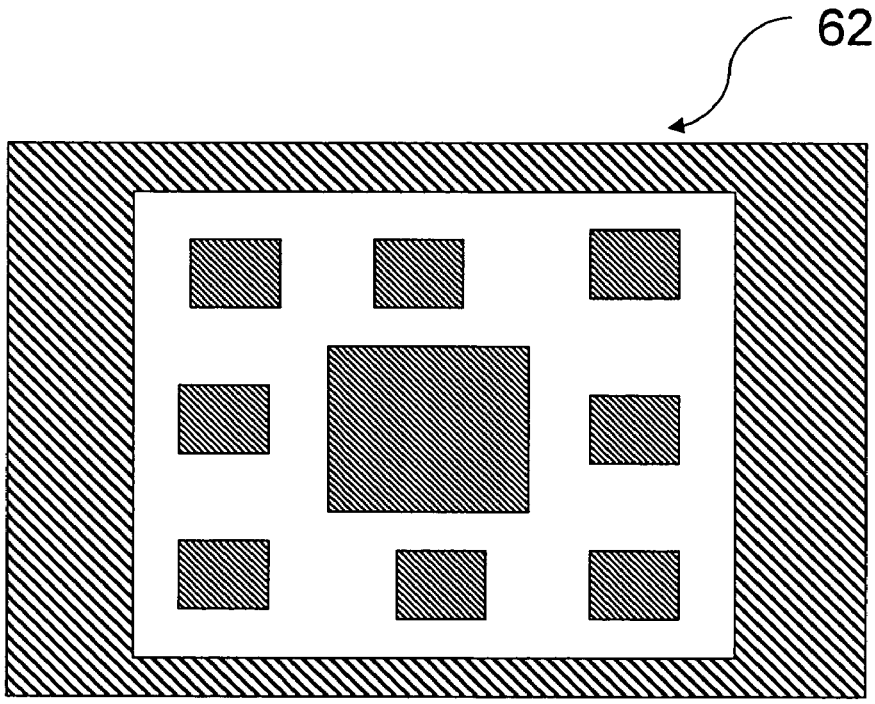

Referring to FIG. 7, another exemplary embodiment of the invention provides an antenna with a vertical array structure, which may increase the gain of the antenna. As shown in FIG. 7, the two sets of antennas are arrayed in such a way that the signal layer 14 of the first set of antenna is formed on one surface of the insulating substrate 42, the ground layer 24 of the first set of antenna is formed inside the insulating substrate 42, the signal layer 15 of the second set of antenna is formed inside the insulating substrate 42, and the ground layer 25 of the second set of antenna is formed on the other surface of the insulating substrate 42. In the embodiments in FIG. 5~7, the signal layers are employed as antennas, while the ground layers are employed as complementary ground layer Referring to FIGS. 8A and 8B, an exemplary embodiment of the invention provides an antenna with a fractal structure, which is called as Siperpinski Carpet, wherein the first fractal structure 61 has the geometric shape as shown in FIG. 8A and the second fractal structure 62 has the geometric shape as shown in FIG. 8B. In this exemplary embodiment, the second fractal structure 62 and the first fractal structure 61 are of a similar shape. In another exemplary embodiment, the second fractal structure 62 and the first fractal structure 61 also have similar geometric shapes, but the area of the etched cavity in the second fractal structure 62 is larger than that of the first fractal structure 61. For example, the area of the cavity of the second fractal structure 62 may be as much as twice that of the first fractal structure 61.

Figure 9A:
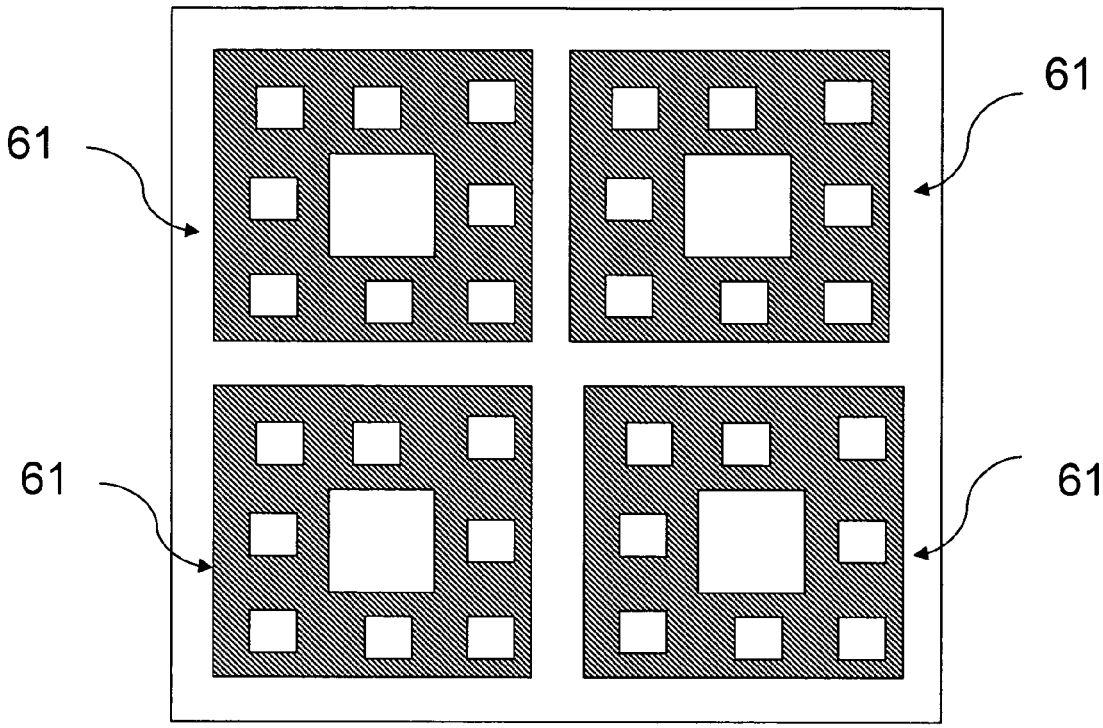
FIG. 9A-9B depicts a vertical complementary fractal antenna according to another exemplary embodiment of the invention.
Figure 9B:
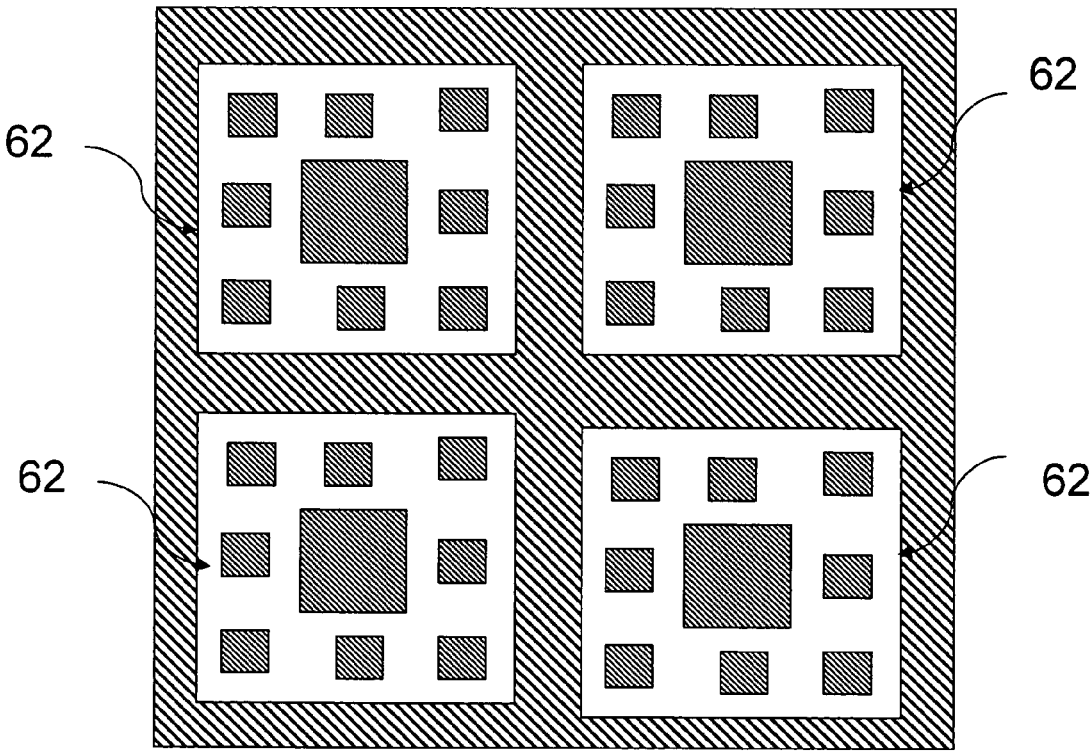

Referring to FIGS. 9A and 9B, another exemplary embodiment of the invention provides an array antenna having fractal structures. In FIGS. 9A and 9B, the fractal structures shown in FIGS. 8A and 8B are used as examples. Certainly, the fractal structures depicted in FIGS. 1-7 or other types of fractal structures can also be used for the array antenna.

Figure 10A:
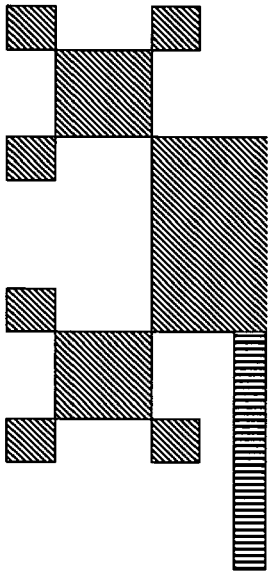
FIG. 10A-10B depicts a vertical complementary fractal antenna according to another exemplary embodiment of the invention.
Figure 10B:
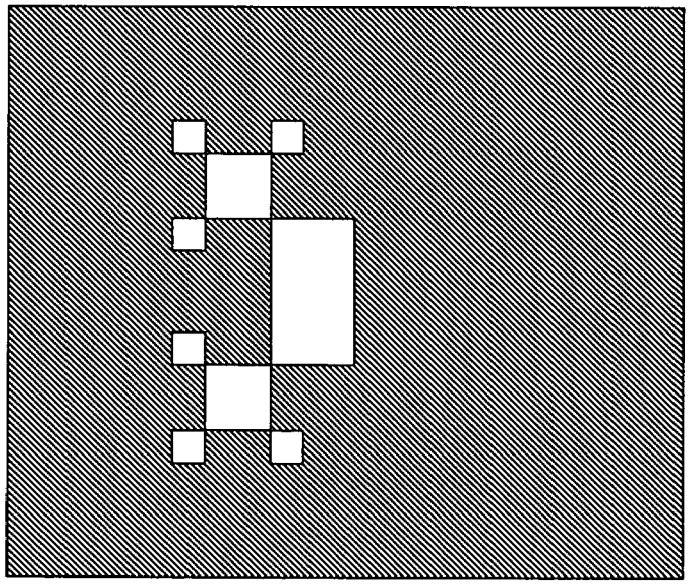

In the exemplary embodiments described above, the half portion of the first fractal structure and the half portion of the second fractal structure are used at the point of zero current of the antenna resonant frequency so as to reduce the area the antenna occupies, as shown in FIGS. 10A and 10B. The half portion of the first fractal structure corresponds to the half portion of the second fractal structure.

Figure 11:
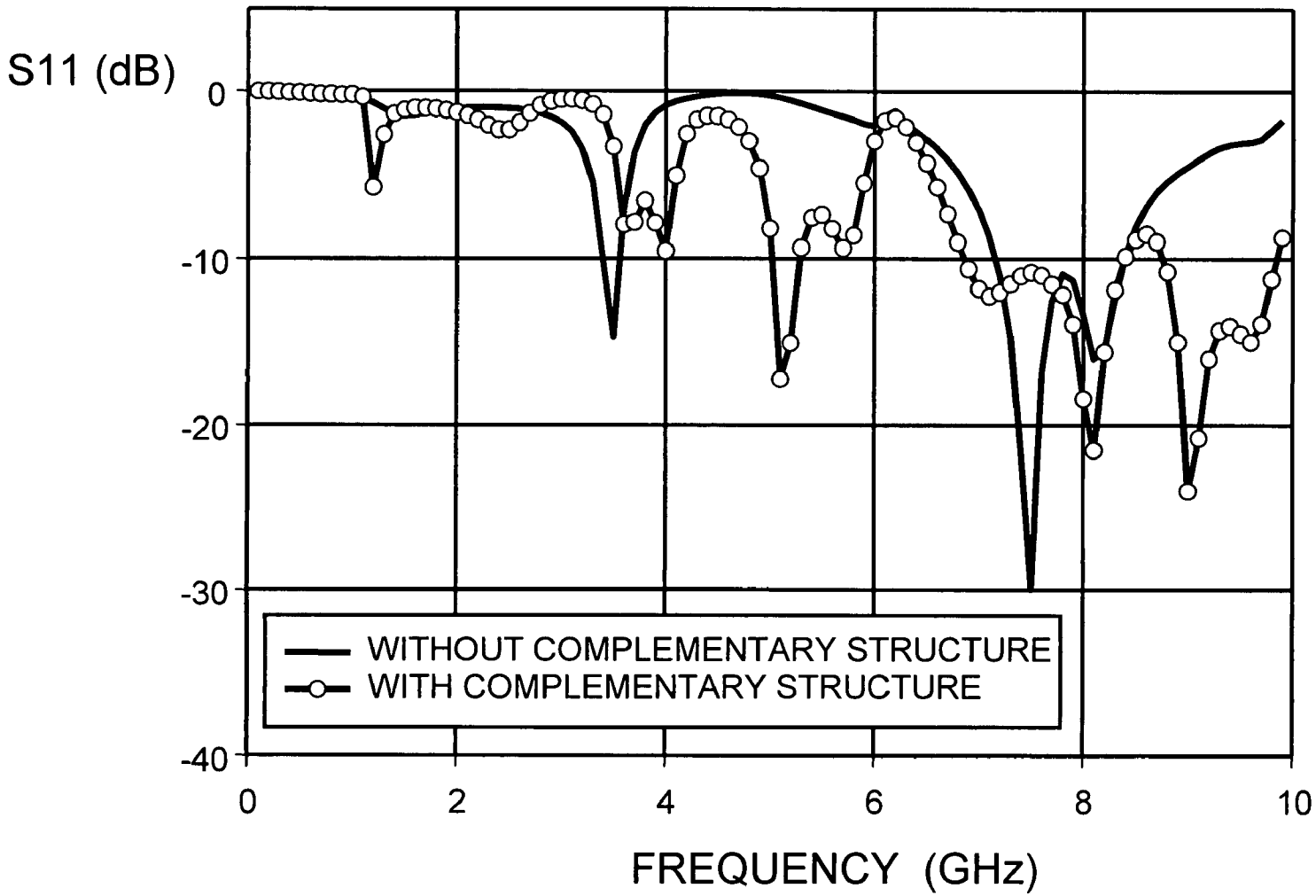
FIG. 11 illustrates the effect of a vertical complementary fractal antenna according to another exemplary embodiment of the invention.

FIG. 11 shows the effect of an antenna having a vertical complementary fractal structure provided in the invention, wherein the thickness of the insulating substrate is 20 mil, DK=3, DF=0.02. The figure shows the difference in bandwidth between an antenna having a second fractal structure complementary to a first fractal structure, and an antenna without a complementary structure, namely, an antenna with only a first fractal structure. In the figure, the curve having round dots represents an antenna having a complementary structure, and the curve without round dots represents an antenna without a complementary structure.

From the observation of the resonant frequency (S11), it is apparent that the bandwidth of an antenna with a complementary structure disclosed in the invention is wider than that of an antenna with an ordinary fractal structure, especially in the high-frequency section, wherein the bandwidth of the antenna with only a first fractal structure is 7.3 GHZ~8.4 GHZ, while the bandwidth of the antenna with a first fractal structure and a second fractal structure complementary to the first fractal structure is 6.8 GHZ~9.8 GHZ. Therefore, the complementary structure increases the bandwidth of the antenna.

As described above, given the multi-band characteristic of fractal antennas, exemplary embodiments of the invention provide a fractal antenna with a complementary ground connection structure wherein the ground layer could be used for radiation so that the antenna may take less space.

The invention being thus described, it will be obvious that the same may be varied in many ways. Such variations are not to be regarded as a departure from the spirit and scope of the invention, and all such modifications as would be obvious to one skilled in the art and are intended to be included within the scope of the following claims.

What is claimed is:

1. A vertical complementary fractal antenna, comprising:

a first fractal structure defined as a superposition over N iterations of a fundamental motif, with N≧1; and a second fractal structure complementary to the first fractal structure, with an area of the second fractal structure being no less than an area of the first fractal structure, wherein a shape of the first fractal structure is different from that of the second fractal structure, and a half portion of the first fractal structure and a half portion of the second fractal structure are used at a point of zero current of an antenna resonant frequency.

2. The vertical complementary fractal antenna according to claim 1, wherein the second fractal structure is formed by etching away an area corresponding to the first fractal structure, and the second fractal structure is of a conductive material.

3. The vertical complementary fractal antenna according to claim 1, wherein the area of the second fractal structure is no larger than twice the area of the first fractal structure.

4. The vertical complementary fractal antenna according to claim 1, further comprising a medium located between the first fractal structure and the second fractal structure.

5. The vertical complementary fractal antenna according to claim 4, wherein the medium is an insulating substrate.

6. The vertical complementary fractal antenna according to claim 5, wherein the first fractal structure is formed on a surface of the insulating substrate and the second fractal structure is formed on another surface of the insulating substrate.

7. The vertical complementary fractal antenna according to claim 5, wherein the first fractal structure is formed on a surface of the insulating substrate and the second fractal structure is formed inside the insulating substrate.

8. The vertical complementary fractal antenna according to claim 4, wherein the medium is air.

9. The vertical complementary fractal antenna according to claim 1, further comprising at least one slot.

10. An array antenna, comprising a plurality of vertical complementary fractal antennas according to claim 1.

11. A vertical complementary fractal antennas, comprising:

a signal layer made of a conductive material having a first fractal structure which is defined as a superposition over N iterations of a fundamental motif, with N≧1; and a ground layer made of a conductive material having a second fractal structure complementary to the first fractal structure, with an area of the second fractal structure being no less than an area of the first fractal structure, wherein a shape of the first fractal structure is different from that of the second fractal structure, and a half portion of the first fractal structure and a half portion of the second fractal structure are used at a point of zero current of an antenna resonant frequency.

12. The vertical complementary fractal antenna according to claim 11, wherein the second fractal structure is formed by etching away an area corresponding to the first fractal structure of the ground layer.

13. The vertical fractal antenna according to claim 11, wherein the area of the second fractal structure is no larger than twice the area of the first fractal structure.

14. The vertical complementary fractal antenna according to claim 11, further comprising a medium located between the signal layer and the ground layer.

15. The vertical complementary fractal antenna according to claim 14, wherein the medium is an insulating substrate.

16. The vertical complementary fractal antenna according to claim 15, wherein the signal layer is formed on a surface of the insulating substrate and the ground layer is formed on another surface of the insulating substrate.

17. The vertical complementary fractal antenna according to claim 15, wherein the signal layer is formed on a surface of the insulating substrate and the ground layer is formed inside the insulating substrate.

18. The vertical complementary fractal antenna according to claim 11, wherein the medium is air.

19. The vertical complementary fractal antenna according to claim 11, wherein the signal layer has at least one slot.

20. The vertical complementary fractal antenna according to claim 11, wherein the ground layer has at least one slot.

21. An array antenna, comprising a plurality of vertical complementary fractal antennas according to claim 11.

22. A vertical complementary fractal structure, comprising:

an insulating substrate;

a plurality of signal layers made of a conductive material, each of the plurality of signal layers having a first fractal structure which is defined as a superposition over N iterations of a fundamental motif, with N≧1; and a plurality of ground layers made of a conductive material, each of the plurality of ground layers having a second fractal structure complementary to the first fractal structure, with an area of the second fractal structure being no less than an area of the first fractal structure, wherein a shape of the first fractal structure is different from that of the second fractal structure, and a half portion of the first fractal structure and a half portion of the second fractal structure are used at a point of zero current of an antenna resonant frequency.

23. The vertical complementary fractal antenna according to claim 22, wherein the second fractal structure is formed by etching away an area corresponding to the first fractal structure of the ground layer.

24. The vertical complementary fractal antenna according to claim 22, wherein the area of the second fractal structure is no larger than the area of the first fractal structure.

25. An array antenna, comprising a plurality of vertical complementary fractal antennas according to claim 22.

* * * * *

UNITED STATES PATENT AND TRADEMARK OFFICE

CERTIFICATE OF CORRECTION

PATENT NO. : 7,453,401 B2
APPLICATION NO. : 11/261568
DATED : November 18, 2008
INVENTOR(S) : Uei-Ming Jow et al.

It is certified that error appears in the above-identified patent and that said Letters Patent is hereby corrected as shown below:

Title Page, Item (12) should read,
--Jow et al.--.

Title Page, Item (75) Inventors: should read,
(75) Inventor: Uei-Ming Jow, Hsinchu (TW)
Chang-Sheng Chen, Hsinchu (TW).

Signed and Sealed this

Seventeenth Day of February, 2009

John Doll

JOHN DOLL
*Acting Director of the United States Patent and Trademark Office*